US005377946A

United States Patent [19]

Pannu

[11] Patent Number: 5,377,946

[45] Date of Patent: Jan. 3, 1995

[54] COMBINED BED TRAY AND BOOK HOLDER

[76] Inventor: Jasdeep S. Pannu, 7100 Almeda Rd., #1123, Houston, Tex. 77054

[21] Appl. No.: 186,977

[22] Filed: Jan. 27, 1994

[51] Int. Cl.[5] ..... A47G 1/24

[52] U.S. Cl. ..... 248/456; 248/463

[58] Field of Search ..... 248/441.1, 451, 454, 248/455, 456, 465, 463, 464; 108/9

[56] References Cited

U.S. PATENT DOCUMENTS

| | | | |
|---|---|---|---|
| D. 132,098 | 4/1942 | Corbett . | |
| D. 132,893 | 6/1942 | Corbett . | |
| D. 135,507 | 4/1943 | Hillenbrand . | |
| D. 145,777 | 10/1946 | Clachko | D33/14 |
| D. 218,980 | 10/1970 | Balkus | D6/1 |
| D. 281,937 | 12/1985 | Roczey | D6/406 |
| 592,780 | 11/1897 | Heath | 248/456 |
| 1,839,291 | 1/1932 | Barbour | 248/460 X |
| 2,054,098 | 9/1936 | Rich | 248/464 |
| 2,547,642 | 4/1951 | Heuser | 311/27 |
| 2,583,097 | 1/1952 | Heimann | 248/456 |
| 3,246,611 | 4/1966 | Benlian | 108/1 |
| 3,481,705 | 1/1970 | Blanke | 108/49 |
| 3,652,051 | 3/1972 | McFarlane | 248/464 X |
| 3,768,768 | 10/1973 | Benlian | 248/464 X |
| 3,773,154 | 11/1973 | Mitchell | 248/455 X |
| 3,813,074 | 5/1974 | Mulvaney | 248/464 X |
| 4,116,413 | 9/1978 | Anderson | 248/451 |
| 4,159,871 | 7/1979 | Arnone | 248/456 X |
| 4,407,523 | 10/1983 | Campione | 248/453 X |
| 4,555,128 | 11/1985 | White | 248/456 X |
| 4,680,681 | 7/1987 | Fisherman et al. | 362/98 |

FOREIGN PATENT DOCUMENTS

| | | | |
|---|---|---|---|
| 235018 | 10/1942 | Switzerland | 248/456 |

*Primary Examiner*—J. Franklin Foss

*Attorney, Agent, or Firm*—Marvin J. Marnock

[57] ABSTRACT

A bed tray (10) with supporting legs (14) and a flat bottom (12) having an insert panel (24) therein which can be positioned at an angle of inclination to thereby serve as a book stand. The insert panel is normally supported co-planar with the top (13) of the flat bottom but is pivotally mounted thereto and by means of a rack and pawl combination (40, 43) it may be positioned at a selected angle of inclination for reading in bed. A straight edge insert (80) is removeably mounted along one edge of the tray whereby it can be removed therefrom and selectively positioned at a preferred height on the inclined panel insert (24) to serve as an adjustable support for the bottom edge of a book. A battery-powered light source (60) is removably mounted in an opening in one edge of the panel insert and provided with a flexible adjustable arm (58) which may be adjusted to position the light (60) above the insert panel for illumination. An optional provision is a page holder (90) in the form of a transparent flexible strip (92) mounted on a spring biased reel (91) fixed at one side of the tray and from which it can be extracted and laid across the pages of an open book (96) to be secured by its free end to the other side of the tray bottom member.

4 Claims, 4 Drawing Sheets

COMBINED BED TRAY AND BOOK HOLDER

FIELD OF THE INVENTION

This invention relates to an article of furniture, and more particularly to a bed tray adapted primarily for use by bedridden persons and which can be readily converted for use as an adjustable book stand to support reading material at a suitably inclined angle for reading in bed.

BACKGROUND OF THE INVENTION

Bed tables and bed trays are of a wide variety of designs including many which incorporate construction whereby the table or tray can be converted to use as a book stand. Reading in bed is a pastime at which almost everyone participates at some time or other, and it is particularly important to those who are bedridden that books or other reading materials can be supported and positioned before them at an optimal height and inclination and also be provided with suitable illumination. For enjoying the pastime of reading in bed, a variety of portable book stands and bed trays have been devised. Such designs include bed tables and bed trays, which in addition to serving as tables or trays incorporate construction features by which they can be readily converted for use as a bookstand. Some of these combination designs include construction features for supporting a book in an inclined readable position and for adjusting the angle of inclination to suit the reader. However, lacking in all the current designs is a means to permit adjusting the height of the book on the inclined surface of the book stand which can be a desirable and important feature, particularly for one whose mobility in bed is restricted. Furthermore, for handicapped persons, such as the arthritic, a page holder which can be easily manipulated and is not all obstruction to visibility of the printed surface, is not found to be incorporated in the contemporary designs. Also lacking is a light source which is incorporated in the structure and can be adjustable positioned with respect to the inclined surface to provide a most suitably directed illumination.

SUMMARY OF THE INVENTION

The invention relates to a bed tray with a flat bottom member having an insert panel mounted therein which can be adjustably positioned at a selected angle of inclination with respect to the top surface of the bottom member to thereby serve as a book rest. The tray bottom member is provided with legs suitable for placing on a bed whereby the tray bridges the torso of a person reclined on the bed. The insert panel is supported such that its top surface is normally co-planar with the flat surface of the tray bottom member but is pivotally mounted to the bottom member for pivotal movement about an axis adjacent to the edge of the bottom member which faces the person in bed. By means of a rack mounted on the bottom member and a pawl pivotally mounted on the insert panel, the rack and pawl combination can be adjusted to position the insert panel at a selected angle of inclination with respect to the tray bottom member which is most preferred by the bed ridden person for reading a book. The tray is also provided with an elongate straight edge insert which serves as a low rim of the tray and is removably mounted along the front edge portion of the tray. The straight edge insert and the insert panel are provided with cooperable pin and socket mounting means whereby the straight edge insert can be selectively positioned at a preferred height on the inclined panel insert to thereby serve as an adjustable support for the bottom edge of a book when placed on the insert panel for reading. The inclinable insert panel is also provided with a battery-powered light source encased in a housing which is removeably mounted in a cut-out opening in one edge of the panel member. The light source housing is also fixed on one end of an elongated flexible bendable arm which is stored in a tubular housing on the underside of the tray bottom member but can be extracted therefrom and adjustably positioned above the insert panel by manipulation of the arm to provide a selected location for illumination. A transparent page holder strip is also an optional provision which is mounted on it spring biased reel fixed to one side of the tray bottom member. The strip can then be extracted and laid across the pages of an open book to be secured at its free end to the other side of the tray bottom member.

DETAILED DESCRIPTION OF THE INVENTION

Figure 1:
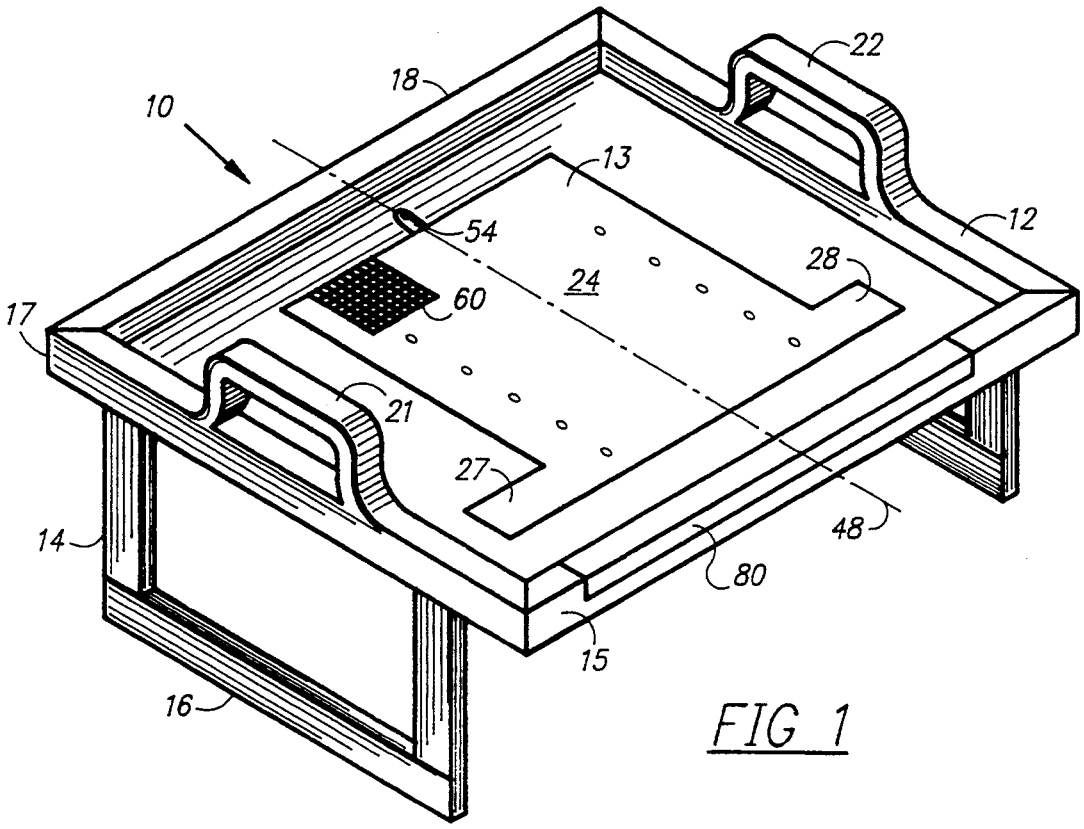
FIG. 1 is a view in perspective of a combined bed tray and book holder representing a preferred embodiment of the invention.
Figure 2:
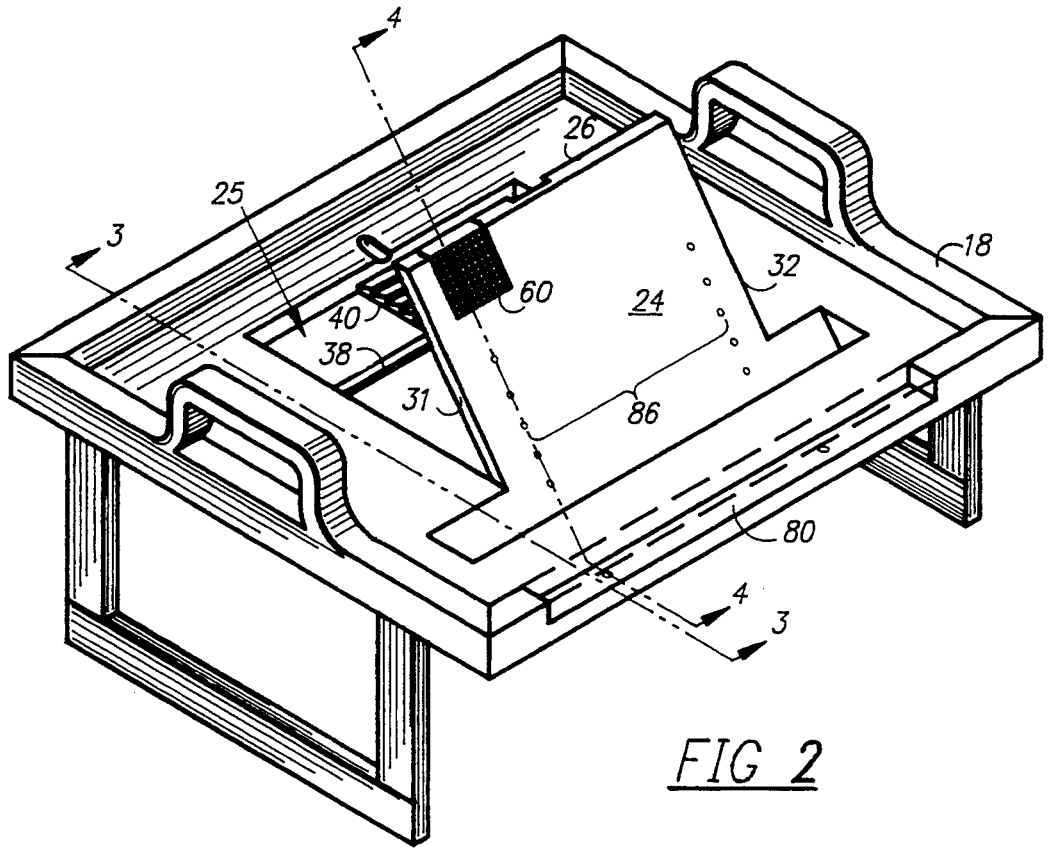
FIG. 2 is a view in perspective of the combined bed tray and book holder of FIG. 1 which has been converted for use as an adjustable book stand for supporting reading material at a suitably inclined angle for reading.
Figure 3:
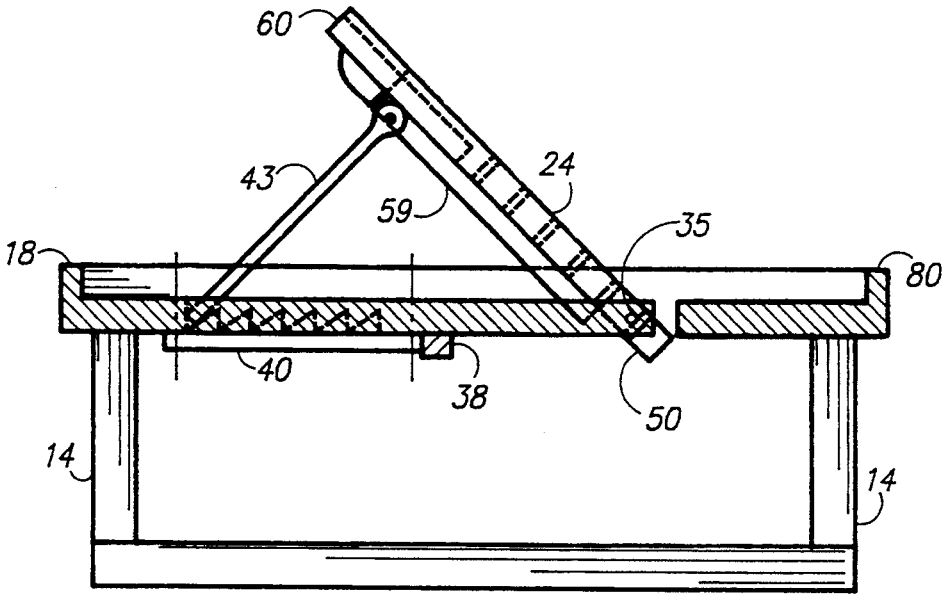
FIG. 3 is a section view as taken along the section line 3—3 in FIG. 2.
Figure 4:
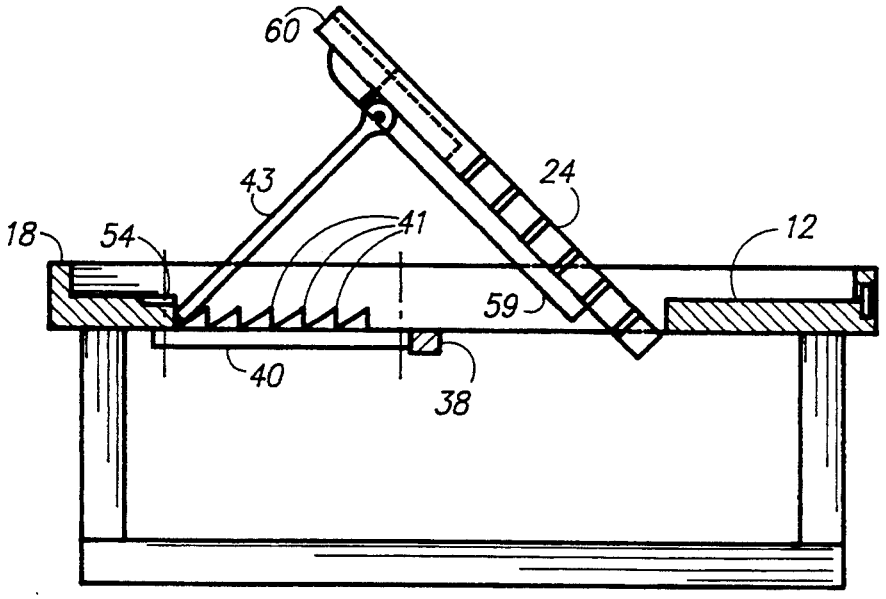
FIG. 4 is a section view as taken along the section line 4—4 in FIG. 2.

Referring more particularly to the drawings, there is shown in FIG. 1, a bed tray 10 having a flat bottom member 12 of rectangular configuration and provided with legs 14. A leg 14 is mounted to the underside of the bottom member 12 adjacent to each corner thereof and at the short sides of the rectangular bottom member, each pair of legs being braced by a horizontal member 16 which extends therebetween at the bottom of each leg. The height of the legs is such that the tray 10 is adapted to be placed on a bed so as to bridge the torso of a person reclined on the bed and thereby provide a convenient support for the various articles the person desires to have accessible.

The flat bottom member 12 is provided with front and rear edges 15 and 17, respectively, and also with a low rim 18 which extends about its perimetric edges and rises approximately 2 cm. above its top surface 13. It is also provided with a pair of handles 21, 22 which are mounted at the sides of the member 12 with each handle of the pair being fixed atop the low rim 18 and centrally located along the side of the flat bottom member 12 on which it is mounted.

The flat bottom member 12 is also provided with a panel insert portion 24 mounted in a cut-out recess 25 which extends from near the rear edge 17 of the bottom member 12 to approximately one inch from the front edge 15. The panel insert 24 and recess 25 are of conforming configuration so as to provide a relatively close fit therebetween and are of generally rectangular shaped and a size adequately suited for serving as a support or book rest for an open book placed therein.

As shown in FIG. 1 of the drawings, the panel insert 24 has a pair of projections 27, 28 extending respectively from the sides 31, 32 of the insert 24 and effectively increasing the length dimension of the forward linear edge 33 of the insert 24.

The insert 24 is mounted on pivot pins 35 provided on opposite sides thereof closely adjacent the projections 27, 28 and extending into accommodating bores formed along edges of the bottom member 12 provided by the recess 25.

The panel insert 24 is adapted to rest and be supported on a brace 38 which is fixed at its ends to the underside of the bottom member 12 and extends laterally across the recess opening 25 substantially parallel to the front and rear edges of the member 12. An elongate rack member 40, which is fixed at one end to the underside of the member 12 near the rear edge 17 of the member 12 and at its other end to the brace 38 also provides support for the panel insert 24. When the insert 24 is positioned to rest atop the brace 38 and rack 24, its top planar surface 24*a* is co-planar with the top surface 13 of the member 12.

The rack member 40 is provided with a plurality of upwardly facing teeth 41 which are adapted for cooperative engagement with one end of an elongate pawl member 43. The pawl 43 is pivotally mounted to an eyelet 45 having a threaded shank portion screwed into the underside of the member 12 at a location near the geometric center of the pawl insert 24 and along its axis of symmetry 48. The pawl 43 is mounted for pivotal movement in a vertical plane when the tray is horizontal and which plane intersects each of the teeth 41.

The pawl member 43 is normally maintained flat against the underside of the member 12 when the panel insert is supported co-planar with the surface 13 of the tray. The pawl is preferably of steel such that it can be secured against a magnet 50 embedded in a bore in the underside of the member 12, although other types of securing means such as mechanical latches could alternatively be employed.

To accommodate the teeth 41 when the panel insert 24 is reclined in its co-planar portion with the tray surface 12 as shown in FIG. 12, the underside of the panel insert is provided with a longitudinal groove 52 which is longitudinally aligned with the axis of symmetry 48 of the bed tray 10. As an alternative, the rack 40 could be designed and mounted such that all of its teeth 41 are located entirely below the underside 11 of the tray 10 thereby eliminating the need for the cut-out groove 52.

It is therefore to be noted, that by means of the rack and pawl combination 40–43, the panel insert 24 can be positioned at an angle with respect to the top surface 12 of the bed tray 10, which angle can be adjusted to suit the preferences of a person for reading in bed. Desirably, the top surface 12 is provided with an indentation 54 which opens at the edge of the recess 25 such that a person may insert a finger in the indentation to press against the panel edge 26 and thereby lift the panel to move about its pivot axis to a position above the rack 40. The pawl 43 can then be dislodged from the magnet 50 and its free end inserted against a selected one of the teeth 41.

Figure 5:
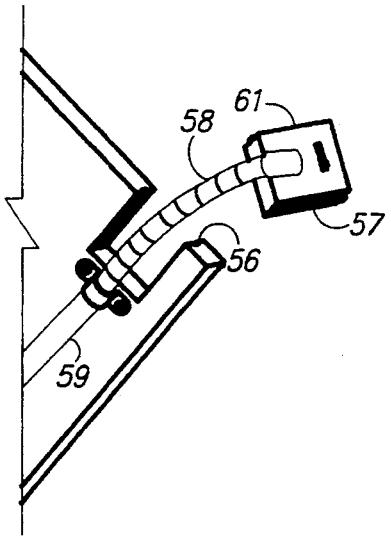
FIG. 5 is a fragmentary perspective view of the underside of the bed tray of FIG. 1 showing the mounting for a light source attached as an insert to the bed tray, wherein the light source housing is removed from its mounted position on the bed tray for adjustable positioning thereabove.
Figure 6:
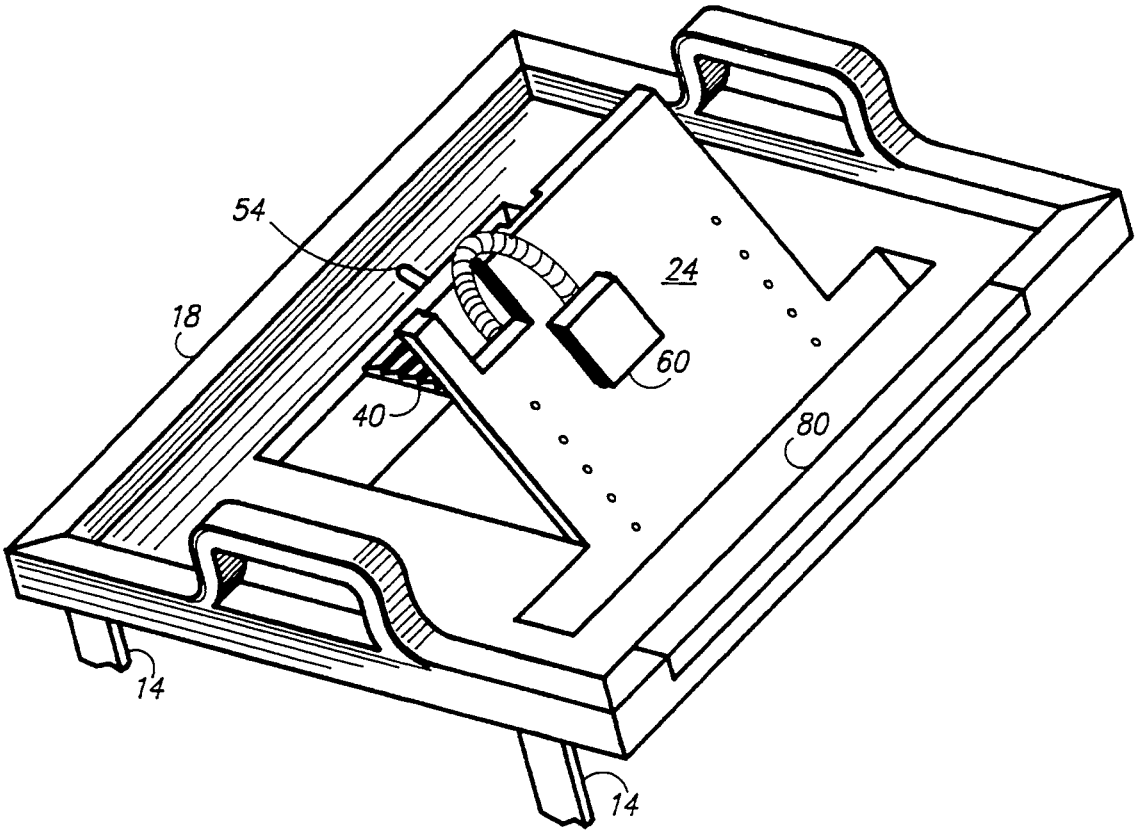
FIG. 6 is a perspective fragmentary view of the invention of FIG. 1, but showing a panel insert of the bed tray positioned at an angle of inclination with respect to the planar top surface of the bed tray and the light source positioned thereabove.

To provide means for illumination, a battery-powered light source 60 of a conventional type is removably mounted in an opening 55 in the panel edge 26 by a means of a tongue and groove connection wherein grooves 56 in edges of the panel formed by the opening 55 are designed to accommodate tongues 57 formed along the sides of the light source housing 61. The light housing 61 is fitted on one end of an adjustable arm 58 which is normally stowed in a tubular housing 59 mounted on the underside of the panel insert 24 as shown in FIG. 5. When illumination for reading is desired, the light can be removed from its mounting in the recess opening 55 of the panel insert 24 and the arm 58 withdrawn a select distance from its housing 59. The arm 58 is a commercially available type having an external flange or fitting (not shown) on its stored end which prevents its being completely removed from the tubular housing 59. The light 60 can than be adjustably positioned a distance above the inclined panel insert 24 as shown in FIG. 6 to provide desired illumination.

To better accommodate reading material of different thicknesses and number of pages, and also different sizes, the combined bed tray and book holder 10 is provided with adjustable support means for supporting the bottom edge of a book at a selected height on the inclined plane of the inclined panel insert 24. The adjustable support means is provided by an elongate rim insert 80 which is removeably mounted in the front rim 18*a* of the bed tray 10. The front rim 18*a* has cut-away groove 81 to accommodate the rim insert 80 which is of conforming configuration and adapted to be removeably inserted therein. The rim insert 80 has a pair of projecting pins 83, which fit snugly in a pair of bores 85 formed in the bottom of the groove 81.

Figure 7:
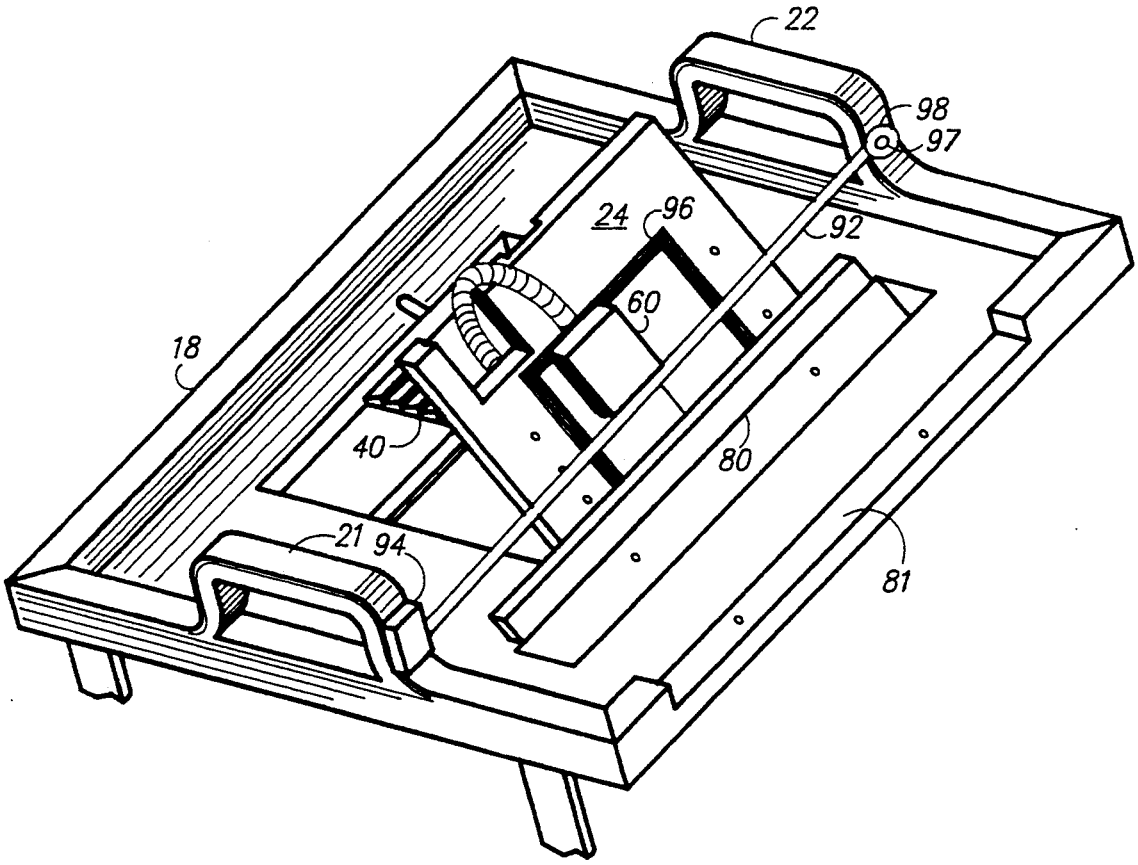
FIG. 7 is a perspective view of the combined bed tray and book holder of FIG. 1 but showing the apparatus converted for use as a book holder suitable for reading in bed.

The rim insert 80 is adapted to be removed from the rim 18 and mounted at a selected height on the panel insert 24. For such purpose, the panel insert 24 is provided with similar pairs of bores 86, which pairs are aligned parallel to the front edge 15 of the bed tray 10, with each pair formed at a different height on the inclined panel insert 24. The insert 80 can then be lifted from the front rim 18*a* and its pins 83 inserted in a selected pair of the panel bores 86 such that the insert 80 is aligned parallel with the front edge 15 of the bed tray 10, as shown in FIG. 7. When thus positioned, the bottom edge of a book 96 placed on the inclined panel insert 24 will abut the front side 89. The insert 80 therefore provides an adjustable support means for supporting a book on the panel insert 24 at a height thereon which best suits the preferences of the reader in bed.

It is also to be seen in FIG.7, a page holder 90 is an option which can be provided with the bed tray 10. The page holder 90 is in the form of a thin transparent strip 92 of flexible plastic material which is stored in a spring-biased reel 94 bonded in any suitable fashion to the tray handle 21. The reel is mounted such that the strip 92 can be withdrawn therefrom against the action of the reel spring and extended to lie across the open pages of a book supported on the inclined panel insert 24. Preferably, the free end of the transparent strip 92 is provided with a grommet or eyelet 97 which is adapted for positioning about a fastening pin 98, or the like, which is mounted on the other side of the bed tray 10 such as on the handle 22. Because of its transparency, the strip 92 does not block the reading material from the view of the reader and owning to the spring bias of the reel 94 will be held against the open pages of a book placed on the panel 24.

It is to be understood that the foregoing description of a preferred embodiment of this invention has been presented for purpose of explanation and illustration and as not intended to limit the invention to the precise form disclosed. For example, the removable rim insert 80 could be located at various positions on the bed tray 10 other than at the front of the tray. The tray itself might be made of a variety of materials. Accordingly, it is to be appreciated that many changes may be made in the structure and materials by those skilled in the art without departing from the spirit of the invention.

I claim:

1. A bed tray having legs whereby the tray may be placed atop a bed and bridge the torso of a person reclined thereon, said tray comprising:

a bottom member having a flat top tray surface with an areal expanse suitable for supporting a tray thereon;

a panel insert provided in said bottom member, said insert having a planar top surface;

means for mounting the panel insert to said bottom member whereby the panel insert is adapted to be supported with its planar top surface in co-planar relationship with the flat top surface of said bottom member;

means for adjustably positioning said panel insert at a selected angle of inclination with respect to the top surface of said bottom member whereby the panel insert can be positioned at a desired angle of inclination suitable for reading a book supported thereon;

a second insert member removably mounted along one edge of said bed tray bottom member;

cooperable mounting means on said second insert member and said panel insert whereby said second insert member may be removed from said bottom member and mounted at a preferred height on the top surface of the panel insert to provide support for the edge of a book placed on the panel insert when the panel insert is at a selected angle of inclination, said means for adjustably positioning the panel insert at a selected angle of inclination including means for connecting the panel insert to said bottom member for pivotal movement about an axis substantially co-planar with the top surface of said bottom member, a rack member mounted on one of said panel insert and said bottom members, and an elongate pawl pivotally mounted to the other of said panel insert and said bottom members for cooperable engagement with said rack member to support the panel insert at a selected angle of inclination with respect to said bottom member.

2. A bed tray having legs whereby the tray may be placed atop a bed and bridge the torso of a person reclined thereon, said tray comprising:

a bottom member having a flat top tray surface with an areal expanse suitable for supporting a tray thereon;

a panel insert provided in said bottom member, said insert having a planar top surface;

means for mounting the panel insert to said bottom member whereby the panel insert is adapted to be supported with its planar top surface in co-planar relationship with the flat top surface of said bottom member;

means for adjustably positioning said panel insert at a selected angle of inclination with respect to the top surface of said bottom member whereby the panel insert can be positioned at a desired angle of inclination suitable for reading a book supported thereon;

a second insert member removably mounted along one edge of said bed tray bottom member, said second insert member being provided with a straight edge on one said thereof and a pair of projecting pins on a second side thereof, said bottom member being provided with a pair of bores which are spaced from one another and sized to snugly receive the pair of projecting pins therein whereby said second insert member can be removably mounted on said bottom member; and cooperable mounting means on said second insert member and said panel insert whereby said second insert member may be removed from said bottom member and mounted at a preferred height on the top surface of the panel insert to provide support for the edge of a book placed on said straight edge of the panel insert when the panel insert is at a selected angle of inclination, said cooperable mounting means comprising said pair of projecting pins and multiple pairs of bores provided in the planar top surface of said panel insert which are spaced and sized to be adapted to receive said projecting pins therein and wherein each pair of bores in the surface of the panel insert are located at different heights thereon when the panel insert is at said selected angle of inclination.

3. A bed tray having legs whereby the tray may be placed atop a bed and bridge the torso of a person reclined thereon, said tray comprising:

a bottom member having a flat top tray surface with an areal expanse suitable for supporting a tray thereon;

a panel insert provided in said bottom member, said insert having a planar top surface;

means for mounting the panel insert to said bottom member whereby the panel insert is adapted to be supported with its planar top surface in co-planar relationship with the flat top surface of said bottom member;

means for adjustably positioning said panel insert at a selected angle of inclination with respect to the top surface of said bottom member whereby the panel insert can be positioned at a desired angle of inclination suitable for reading a book supported thereon;

a second insert member removably mounted along one edge of said bed tray bottom member; and cooperable mounting means on said second insert member and said panel insert whereby said second insert member may be removed from said bottom member and mounted at a preferred height on the top surface of the panel insert to provide support for the edge of a book placed on the panel insert when the panel insert is at a selected angle of inclination;

a battery powered light source encased in a housing with an elongate flexible bendable arm affixed thereto, said inclinable insert member having a recess opening in the top edge thereof which is of a configuration adapted to receive said light source housing snugly therein; and means for removably supporting said light source in said recess opening whereby the light can be partially extended therefrom and be adjustably positioned above said panel insert by manipulation of the bendable arm to provide illumination for a book supported on said inclined panel which is suitable for reading by a person reclined in the bed.

4. A bed tray having legs whereby the tray may be placed atop a bed and bridge the torso of a person reclined thereon, said tray comprising:

a bottom member having a flat top tray surface with an areal expanse suitable for supporting a tray thereon;

a panel insert provided in said bottom member, said insert having a planar top surface;

means for mounting the panel insert to said bottom member whereby the panel insert is adapted to be supported with its planar top surface in co-planar relationship with the flat top surface of said bottom member;

means for adjustably positioning said panel insert at a selected angle of inclination with respect to the top surface of said bottom member whereby the panel insert can be positioned at a desired angle of inclination suitable for reading a book supported thereon;

a second insert member removably mounted along one edge of said bed tray bottom member;

cooperable mounting means on said second insert member and said panel insert whereby said second insert member may be removed from said bottom member and mounted at a preferred height on the top surface of the panel insert to provide support for the edge of a book placed on the panel insert when the panel insert is at a selected angle of inclination;

an elongate flexible transparent strip element wound on a reel journalled for rotation in a housing mounted on one side of said tray bottom member, said housing having an opening whereby the transparent strip element can be unwound from the reel and extracted through said opening to be laid across the pages of an open book placed on said panel insert; and means for fastening the free end of said strip element to the opposite side of said tray bottom member and for holding said strip element in taut condition whereby said strip element is adapted to serve as a page holder for said book.

* * * * *